US009121241B2

(12) United States Patent
Ferkingstad et al.

(10) Patent No.: US 9,121,241 B2
(45) **Date of Patent: *Sep. 1, 2015**

(54) STROKER DEVICE

(71) Applicant: Altus Intervention AS, Stavanger (NO)

(72) Inventors: Karl Einar Ferkingstad, Kopervik (NO); Arne Motland, Stavanger (NO); Rune Bjorndal, Stavanger (NO)

(73) Assignee: Altus Intervention AS, Stavanger (NO)

( * ) Notice: Subject to any disclaimer, the term of this patent is extended or adjusted under 35 U.S.C. 154(b) by 0 days.

This patent is subject to a terminal disclaimer.

(21) Appl. No.: 14/269,900

(22) Filed: May 5, 2014

(65) Prior Publication Data

US 2014/0238695 A1 Aug. 28, 2014

Related U.S. Application Data

(63) Continuation of application No. 13/264,088, filed as application No. PCT/NO2010/000144 on Apr. 19, 2010, now Pat. No. 8,739,891.

(30) Foreign Application Priority Data

Apr. 22, 2009 (NO) ..... 20091611

(51) Int. Cl.
*E21B 23/04* (2006.01)
*E21B 4/18* (2006.01)
*E21B 23/00* (2006.01)

(52) U.S. Cl.
CPC . *E21B 23/04* (2013.01); *E21B 4/18* (2013.01); *E21B 2023/008* (2013.01)

(58) Field of Classification Search
CPC ... E21B 23/04; E21B 2013/008; E21B 23/00; E21B 4/18; E21B 23/14
USPC ..... 166/241, 98, 117.7, 209, 212, 172, 384, 166/385, 373, 381, 382, 113; 175/73, 325, 175/399, 99
See application file for complete search history.

(56) References Cited

U.S. PATENT DOCUMENTS

| | | | | |
|---|---|---|---|---|
| 6,454,011 | B1 | 9/2002 | Schempf et al. | |
| 6,684,965 | B1 | 2/2004 | Bakke | |
| 7,334,642 | B2 | 2/2008 | Doering et al. | |
| 8,739,891 | B2 * | 6/2014 | Ferkingstad et al. | 166/381 |
| 2003/0029618 | A1 | 2/2003 | Schempf et al. | |
| 2005/0145415 | A1 | 7/2005 | Doering et al. | |
| 2005/0263325 | A1 | 12/2005 | Doering et al. | |
| 2005/0269108 | A1 | 12/2005 | Whanger et al. | |
| 2006/0180318 | A1 | 8/2006 | Doering et al. | |
| 2008/0314639 | A1 | 12/2008 | Kotsonis et al. | |

FOREIGN PATENT DOCUMENTS

| | | | |
|---|---|---|---|
| EP | 1640556 | A1 | 3/2006 |
| WO | 9521987 | | 8/1995 |
| WO | 2008091157 | A1 | 7/2008 |
| WO | 2008128543 | A2 | 10/2008 |

* cited by examiner

*Primary Examiner* — Yong-Suk (Philip) Ro
(74) *Attorney, Agent, or Firm* — Gable Gotwals

(57) ABSTRACT

This inventions relates to a stroker device (1) for use in a borehole (2) in the ground. The stroker (1) comprises at least an actuator (6) arranged for displacing a tool (10) in a longitudinal direction of the borehole (2) and grippers (26) arranged to anchor the stroker (1) to the wall (36) of the borehole (2), alternatively to a pipe wall. The stroker (1) is provided with driving wheels (34) or driving belts for propulsion.

8 Claims, 2 Drawing Sheets

STROKER DEVICE

CROSS-REFERENCE TO RELATED APPLICATIONS

This application is a continuation of U.S. patent application Ser. No. 13/264,088 filed on 12 Oct. 2011, which was the United States National Phase of PCT Patent Application No. NO2010/000144 filed on 19 Apr. 2010, which was published in English on 28 Oct. 2010 under Publication No. WO 2010/123375 A1, which claims priority to Norwegian Patent Application No. 2009 1611 filed 22 Apr. 2009, both of which are incorporated herein by reference.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable

STATEMENT REGARDING PRIOR DISCLOSURES BY THE INVENTOR OR A JOINT INVENTION

Not Applicable

BACKGROUND OF THE INVENTION

The present invention relates to a stroker. The invention relates more particularly to a stroker for use in a borehole in the ground, the stroker at least comprising an actuator arranged for being able to displace a tool in the longitudinal direction of the borehole, and grippers arranged to anchor the stroker to the wall of the borehole, alternatively to a pipe wall.

The English term stroker is used in the original description as the term is common in the petroleum industry.

During downhole work operations, especially in so-called deviated wells, it is common practice to connect a wireline tractor to a stroker to enable displacement of the stroker to the work location.

A stroker is typically four to six meters long, while a wireline tractor is generally about five to seven meters long. The overall length can therefore be up to thirteen meters, which might lead to sluicing problems at the surface valve and complicate downhole operations.

A further disadvantage with prior art stroker-wireline tractors is that the control system for one of the units must be switched off in order to operate the other. This is because the two machines utilize the same cables in the wireline for power supply and control. It is known that this lack of simultaneous control, due to gravitation and forces from fluid flowing in the borehole, may result in displacement of the wireline tractor during the time span between disconnection of the wireline tractor's control system and the anchoring of the stroker, which might cause failure of the downhole work operation.

BRIEF SUMMARY OF THE INVENTION

It is the object of the present invention to remedy or reduce at least one of the disadvantages with prior art.

The object is achieved in accordance with the present invention, by the features given in the description below, and in the subsequent claims.

There is provided a stroker for use in a borehole in the ground, the stroker comprising at least an actuator arranged for displacing a tool in the longitudinal direction of the borehole, and grippers arranged to anchor the stroker in the wall of the borehole, alternatively to a pipe wall, wherein the stroker is provided with driving wheels or driving belts for propulsion.

By providing the stroker with a propulsive module renders the connection to a wireline tractor superfluous, even during operations in deviated wells. This results in a considerably reduced overall length compared to prior art.

At least the grippers and the propulsive module can be controlled through a common control module and power can be supplied through a common power means.

The actuator, grippers and propulsive module can be supplied with hydraulic pressure fluid from a common hydraulic module.

It is thus well arranged for controlling the different functions, including propulsion, simultaneously from a common control means, power supply and hydraulic module.

Even if oil-hydraulics is normally used, the actuator, grippers and the propulsive means, might, given the right conditions, separately or collectively be electrically driven.

The provided stroker solves a long felt problem in relation to overall length and lack of co-ordination of assembled machines in connection with a wireline. A stroker in accordance with the present invention is considerably more flexible in the work operations than a prior art stroker-wireline tractor.

BRIEF DESCRIPTION OF THE DRAWINGS

In the following is described an example of a preferred embodiment which is illustrated in the enclosed drawings, where.

DETAILED DESCRIPTION OF THE INVENTION

Figure 1:
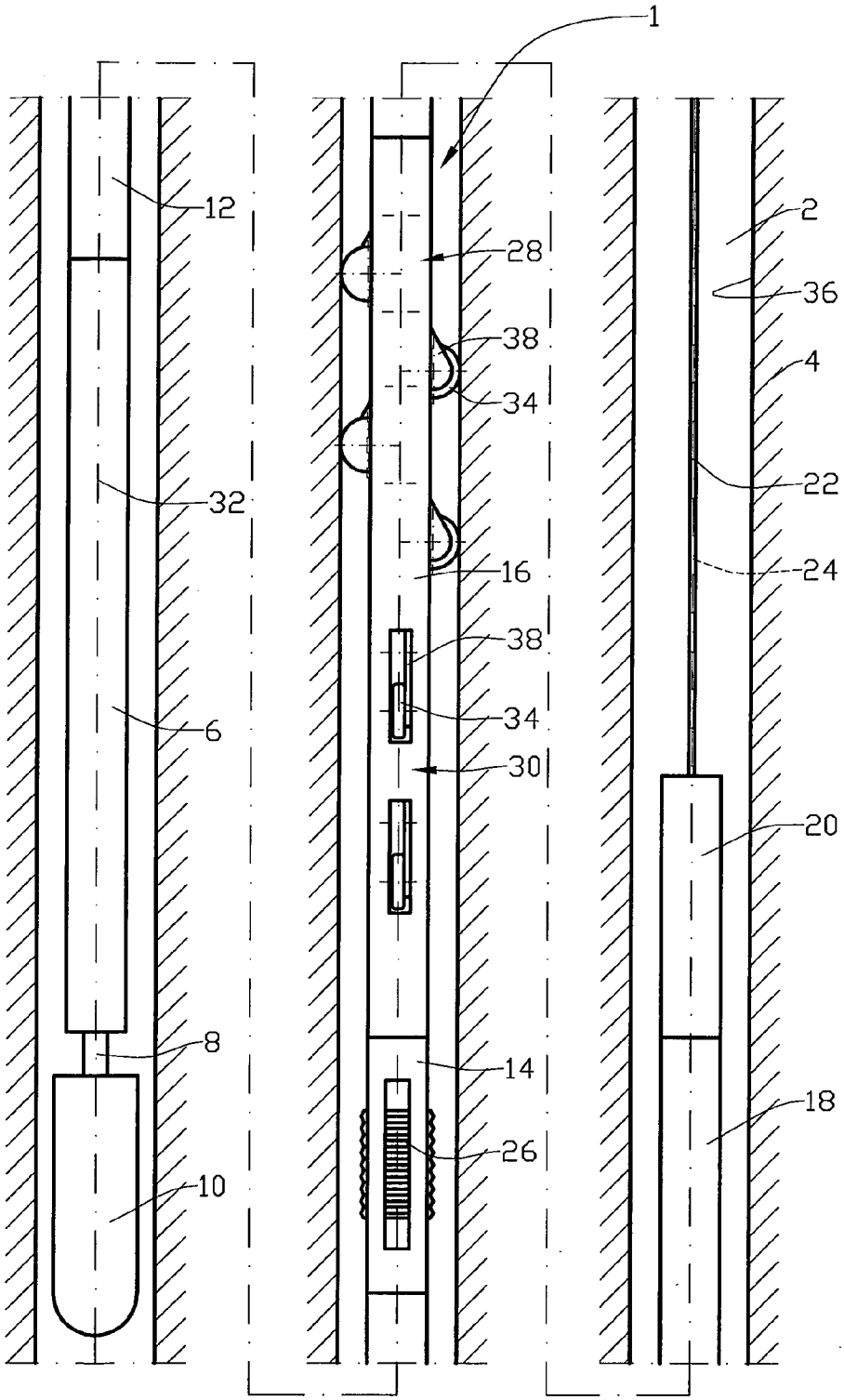
FIG. 1 shows a schematic view of the stroker in accordance with the present invention, during displacement in a borehole.

In the drawings the reference number 1 indicates a stroker located in a borehole 2 in the ground 4. The borehole 2 can, in a way known per se, be cased and provided with not shown completion pipes in which the stroker is displaced.

The stroker 1 comprises an actuator 6 with a bolt- or piston rod, indicated below as an actuator rod 8, being arranged to displace a tool 10 of any known type in the longitudinal direction of the borehole 2.

The stroker 1 further comprises a hydraulic module 12, a gripper module 14, a propulsive module 16, a control module 18 and a power module 20. The stroker 1 is connected to necessary but not shown utility equipment known per se, at the surface by means of a wireline 22 comprising power- and control cables 24.

The hydraulic module 12, the gripper module 14 with grippers 26, the control module 18 and the power module 20, and also not shown pipes and cables for connection, are designed in a way known per se for a stroker, but are extended to comprise the propulsive module 16 as well.

The propulsive module 16 is designed with a first set of driving wheels 28 and a second set of driving wheels 30 which are mutually rotated 90 degrees about the longitudinal axis 32 of the stroker 1. Each set of driving wheels 28, 30 comprise four driving wheels 34 forced to the wall 36 of a borehole 2 by means of accompanying driving wheel arms 38.

Two of the driving wheels 34 are arranged on radially opposite side of the propulsive means 16 relatively the other two driving wheels 34. The first and the second driving module 28, 30 are thereby centering the propulsive means 16 in the borehole 2.

Incidentally, the propulsive means 16 is designed in a way known per se from the art of wireline tractors.

When an operation is to be carried out by means of the tool 10 at a certain position in the borehole 2, the stroker 1 is driven by the propulsive module 16 to the operation position. The driving wheels 34 are forced to the wall 36 of the borehole during the propulsion and after the stroker 1 has stopped at the operation position. The driving wheels 34 are also controlled as the grippers 26 of the gripper module 14 are forced to the wall 36 of the borehole. The stroker 1 is thereby prevented from displacement in the borehole 2 as the grippers 26 are forced up.

Figure 2:
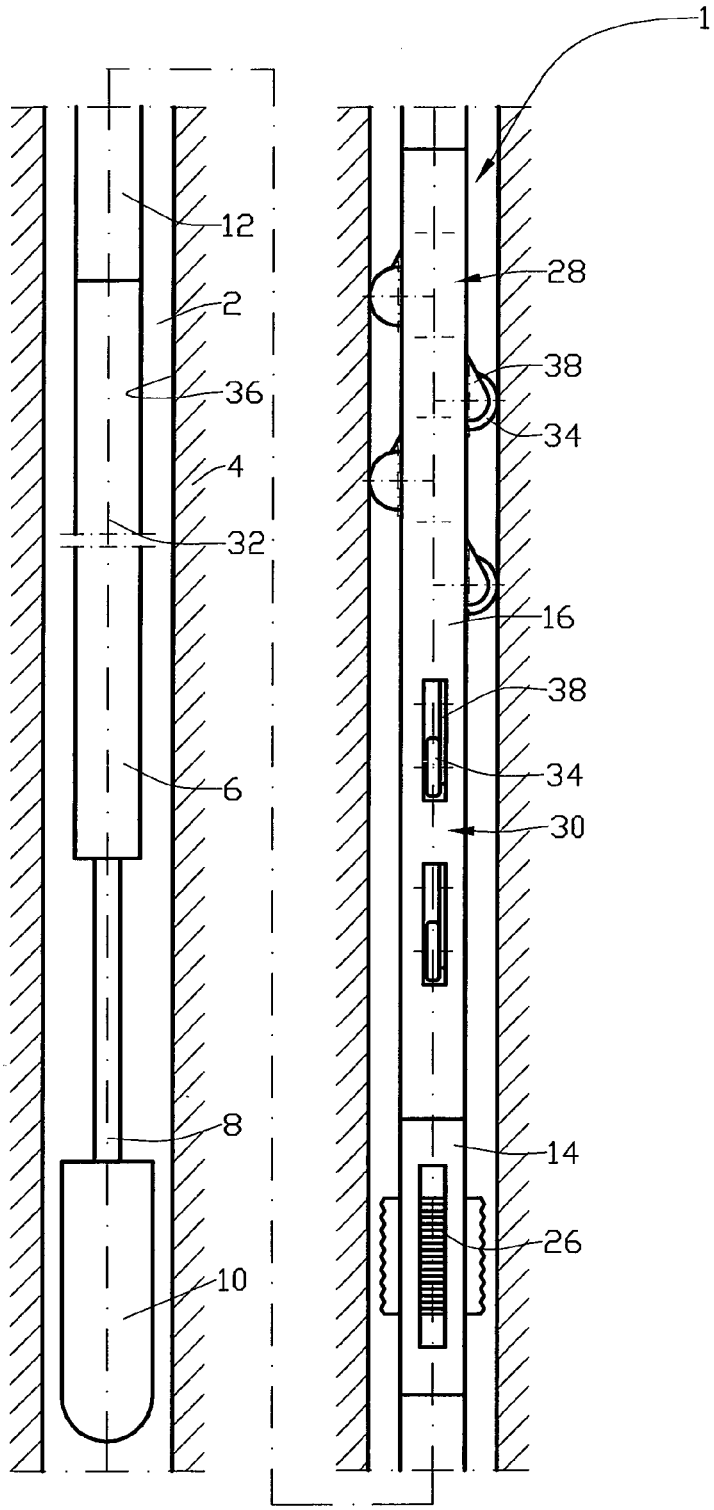
FIG. 2 shows a schematic view of a lower part of the stroker in FIG. 1, the stroker being anchored to the wall of the borehole.

In FIG. 2 the stroker 1 is anchored to the wall 36 of the borehole by means of the grippers 26, as the actuator rod 8 displaces the tool 10 during execution of the work.

The invention claimed is:

1. A system for deploying a stroker device for use in a borehole, the system comprising:

actuator means for displacing a tool in a longitudinal direction of the borehole;

gripping means for preventing displacement of the stroker device relative to a wall of the borehole;

propulsion means for driving the stroker device to an operation location, the propulsion means being mutually rotated approximately 90 degrees about the longitudinal axis of the stroker device;

hydraulic pressure fluid means for commonly supplying hydraulic pressure fluid to the actuator means, the gripper means and the propulsion means;

control means for commonly controlling at least the gripping means and the propulsion means simultaneously; and power means for commonly supplying power to at least the gripping means and the propulsion means.

2. The stroker device according to claim 1 wherein displacement of the stroker device to the operation location does not require connecting a wireline tractor to the stroker device.

3. The stroker device according to claim 1 wherein the propulsion means for driving the stroker device includes driving wheels.

4. The stroker device according to claim 1 wherein the propulsion means for driving the stroker device includes driving belts.

5. A method of deploying a stroker device for use in a borehole, the method comprising the steps of:

displacing a tool in a longitudinal direction of the borehole using actuator means; for displacing the tool;

using gripper means for preventing displacement of the stroker device relative to a wall of the borehole;

using propulsion means for driving the stroker device to an operation location, the propulsion means being mutually rotated approximately 90 degrees about the longitudinal axis of the stroker device;

using hydraulic means for commonly supplying hydraulic pressure fluid to the actuator means, the gripping means and the propulsion means;

using control means for commonly controlling at least the gripping means and the propulsion means simultaneously; and using power means for commonly supplying power to at least the gripping means and the propulsion means.

6. A method according to claim 5 wherein displacement of the stroker device to the operation location does not require connecting a wireline tractor to the stroker device.

7. The stroker device according to claim 5 wherein the propulsion means for driving the stroker device includes driving wheels.

8. The stroker device according to claim 5 wherein the propulsion means for driving the stroker device includes driving belts.

* * * * *